US008006352B2

(12) United States Patent
Roiser

(10) Patent No.: US 8,006,352 B2
(45) Date of Patent: Aug. 30, 2011

(54) GRIPPING HANDLE

(75) Inventor: Thomas Roiser, Mondsee (AT)

(73) Assignee: KOMPERDELL Sportartikel Gesellschaft m.b.H., Mondsee (AT)

( * ) Notice: Subject to any disclaimer, the term of this patent is extended or adjusted under 35 U.S.C. 154(b) by 432 days.

(21) Appl. No.: 12/091,073

(22) PCT Filed: May 24, 2006

(86) PCT No.: PCT/AT2006/000211

§ 371 (c)(1),
(2), (4) Date: Sep. 9, 2008

(87) PCT Pub. No.: WO2007/048150

PCT Pub. Date: May 3, 2007

(65) Prior Publication Data

US 2008/0313852 A1 Dec. 25, 2008

(30) Foreign Application Priority Data

Oct. 24, 2005 (AT) ..... GM721/2005

(51) Int. Cl.
*B25G 1/00* (2006.01)

(52) U.S. Cl. ..... 16/436; 16/421; 16/431; 16/DIG. 12; 16/DIG. 19; 280/821

(58) Field of Classification Search ..... 16/436, 16/430, 431, DIG. 12, DIG. 19, DIG. 18; 280/819, 822, 823, 821; 294/98, 59; 473/300, 473/301, 551, 552, 568
See application file for complete search history.

(56) References Cited

U.S. PATENT DOCUMENTS

| | | | | |
|---|---|---|---|---|
| 2,205,769 | A * | 6/1940 | Sweetland | 81/492 |
| 3,606,326 | A * | 9/1971 | Sparks et al. | 473/300 |
| 3,685,850 | A * | 8/1972 | Kepka et al. | 280/821 |
| 4,053,676 | A * | 10/1977 | Kaminstein | 428/313.5 |
| 4,182,258 | A | 1/1980 | Presser | |
| 4,288,101 | A * | 9/1981 | Aho | 280/821 |
| 4,785,495 | A | 11/1988 | Dellis | |
| 5,289,735 | A * | 3/1994 | Kato et al. | 74/543 |
| 5,299,802 | A | 4/1994 | Bouchet-Lassale | |
| 5,920,943 | A | 7/1999 | Barker | |
| 6,264,242 | B1 * | 7/2001 | Lenhart | 280/822 |

(Continued)

FOREIGN PATENT DOCUMENTS

| | | |
|---|---|---|
| AT | 240229 | 5/1965 |

(Continued)

OTHER PUBLICATIONS

Search report of AT 008374.

*Primary Examiner* — Chuck Y. Mah
(74) *Attorney, Agent, or Firm* — Young & Thompson

(57) ABSTRACT

A part which can be manually gripped, for example a handle (2), especially for athletic poles, has a core (14) of soft or hard foamed plastic and a covering (12) of leather or textile material or an imitation of such sheet materials. In the core (14) there is a blind hole (20) which is open toward the lower end (5) of the handle (2) and which, when the core consists of soft foam, is formed by a sleeve (16) which is closed on the upper end and which is embedded in the core (14).

28 Claims, 3 Drawing Sheets

U.S. PATENT DOCUMENTS

| | | | | |
|---|---|---|---|---|
| 6,311,370 | B1 * | 11/2001 | Blin | 16/436 |
| 6,370,783 | B1 | 4/2002 | Bozikis et al. | |
| 2003/0042726 | A1 * | 3/2003 | Wang | 280/821 |
| 2005/0128864 | A1 | 6/2005 | Holcomb et al. | |
| 2006/0124158 | A1 * | 6/2006 | Lin et al. | 135/24 |
| 2006/0174450 | A1 * | 8/2006 | Chen | 16/436 |

FOREIGN PATENT DOCUMENTS

| | | | |
|---|---|---|---|
| AT | 363024 | | 7/1981 |
| AT | 006848 | | 5/2004 |
| DE | 25 18 425 | A1 | 11/1976 |
| DE | 26 34 656 | B1 | 2/1978 |
| DE | 4304965 | | 9/1993 |
| DE | 20203263 | | 7/2002 |
| DE | 102004008556 | | 9/2005 |
| DE | 102004048545 | | 9/2005 |
| EP | 0044588 | | 1/1982 |
| EP | 0400279 | | 12/1990 |
| JP | 63267520 | | 11/1988 |
| JP | 10225313 | | 8/1998 |
| JP | 2002309808 | | 12/2002 |

* cited by examiner

GRIPPING HANDLE

The invention relates to a part which can be gripped manually, especially a handle, especially of the type which can be used for poles or sticks.

These poles or sticks can be rehabilitation canes, crutch poles, walking sticks, hiking sticks, sticks for mountain climbing, hunting sticks, athletic poles, but also athletic poles for winter sports, such as ski poles, cross country poles or poles for nordic walking.

Within the framework of the invention handles for sports gear of any type, for example handles for golf clubs, tennis rackets, and the like are included.

The part which can be gripped manually as claimed in the invention, especially a handle, however can also be used for equipment other than athletic gear, for example for tools, such as screwdrivers, motor vehicle gearshifts, and furthermore any actuating levers of apparatus and machines.

Generally speaking, the part as claimed in the invention can always be used wherever articles are to gripped by one or both hands. Thus grips for motorcycles, bicycles, and the like are included. If accordingly in this specification a "handle" is addressed, also other parts which can be manually gripped or held in the hand are intended.

BACKGROUND OF THE INVENTION

The known embodiments of handles, especially of those for poles and sticks, consist either in one or more parts of plastic, cork or a cork-like material, handles of foamed plastic also being known.

Handles are also known which consist entirely of foamed plastic, a separate holding part within the foamed plastic handle being provided for attachment of a loop (compare AT 006 848 U1).

Handles for sticks and poles and tools are also known which are covered with a sheet substance. This is generally accomplished by the core of the handle being covered with a sleeve of sheet material, for example leather or a leather-like material. This is tedious work and requires precise pattern cutting and preparation of the sheet material, reworking also being necessary, for example when the sleeve or the tubing has been drawn from the sheet material over the core of the handle, so that it is ensured that the sheet material of the handle also tightly adjoins the core everywhere.

SUMMARY OF THE INVENTION

The object of the invention is to make available a part of the initially named type which is lined with a covering, for example of a material which is easy to grip and which can be easily produced.

This object is achieved as claimed in the invention with a part (handle) which has the features of claim 1.

Preferred and advantageous embodiments of the invention are the subject matter of the dependent claims.

Because the part as claimed in the invention, especially a handle, has a core which is covered with a lining of largely any sheet material, such as for example cloth, sealed textile fabric, for example fabric which is coated or lined on its inside with a plastic film, or also leather or a leather-like material (artificial leather) or with a lining of textile material or of hide, the advantages of plastics for producing parts of handles of the initially named type are maintained and a handle property which is pleasant to the user who is holding the part (good haptic properties) is ensured. Moreover the choice of the material for the lining of the part as claimed in the invention makes it possible to adapt the handle properties to the respectively defined purpose of the part (handle).

The part as claimed in the invention, even if it is a handle, is not limited to use on poles or sticks. Rather the handle can also be used for other purposes, for example actuating levers, control levers, gearshifts and the like, as well as the aforementioned applications.

In one embodiment the core of the part as claimed in the invention, especially of the handle, consists of hard foamed plastic, in which there is directly a recess for holding a part which is to be attached to the part as claimed in the invention, for example, of the upper end of a rod, for example of the tube of a pole. In this embodiment a loop which can be attached if necessary to the part can be attached directly to the core material of the part if a type of attachment using a holding part as is known from AT 006 848 U1 is not used.

In another embodiment the core material, therefore the material of the part, especially of the handle, which is provided under the external covering of sheet material (lining), consists of soft plastic, so that a property which is especially favorable for gripping, specifically softness, of the part is achieved. In this embodiment it is preferred if a tube, especially a plastic tube, is inserted into the soft material; this tube is intended for holding a rod, for example a pole tube or other part to which the part, especially the handle, is to be attached.

In both embodiments, the core of the part as claimed in the invention, especially of the handle, is preferably a foamed plastic which is made either as hard foam or soft foam. Within the framework of the invention a core which is made in at least two parts, for example from two plastics with different properties, for example hardnesses, is included.

Within the framework of the invention parts are also included as are slipped onto pole tubes underneath the actual handle in athletic poles, especially ski poles (for alpine skiing and for cross country skiing and also for nordic walking) (so-called handle extensions).

The part as claimed in the invention, especially the handle, can have a one-piece core which has been produced for example in an injection molding process from thermoplastic or from curing plastic. Likewise the core of the part (handle) as claimed in the invention (handle) can consist of a plastic which is foamed in a mold (especially polyurethane foam).

But, within the framework of the invention, parts, especially handles which are made in two pieces, are also included. In this connection the outside of each half of the part is provided with a lining of sheet material and the two half shells of the part are then joined to one another, for example cemented.

If a loop is to be attached to the part as claimed in the invention, especially the handle, the loop can be attached in a holding part in the core of the part which is fixed by injection in place with the material of the core in the part.

The invention also relates to a process for producing parts (handles) as claimed in the invention with which these parts can be produced especially easily and advantageously. In its general form the covering (lining) of the part, therefore the sheet material is placed in the mold and then the material of the core of the part is added. In this connection it is preferably such that the sheet material is pressed under the pressure of the core material against the inside wall of the mold, and thus assumes from the mold the desired outside contour of the part with all details, and is fixed by the material of the core of the part which later becomes hard.

This procedure has the advantage that the covering, therefore the lining of sheet material, is securely joined in one step to the part, especially the handle, so that this covering is securely held on the part.

The pressure with which the lining of sheet material is pressed against the inside surface of the mold can be the injection pressure of the material (especially plastic, preferably thermoplastic or curing plastic), with which it is injected into the mold. Alternatively or in addition the pressure can also be formed by the plastic foaming in the mold and the lining (covering) of sheet material being pressed by the foam pressure against the inside surface of the mold.

Combinations of the two measures are also possible; this is especially of interest when there are parts, especially handles, of combined core material, soft/hard, especially a hard core inside, a softer layer outside, and the outer covering (of sheet material).

With the process as claimed in the invention both half shells and complete parts can be produced.

If other components, such as pole tubes and/or loops, are to be attached to the part, especially the handle, there is the possibility of joining them to the core either directly in the injection process, or of providing inserts (holding parts) in the core, for example sleeves for holding the pole tubes or holding devices for loops or the like, which are held fast by the material of the core, and are secured in their desired position.

With the process as claimed in the invention any shapes of parts, especially of handles for any applications, especially for any type of athletic gear, can be produced. In particular the process as claimed in the invention allows handles to be provided without great effort with haptically advantageous surface materials, especially textile surfaces, without existing shapes having to be covered with textile (sheet) material.

The process as claimed in the invention also makes it possible to produce the part, especially the handle, in the hardness which is especially advantageous for its application, and there can also be regions of different hardness in one part. For example the region of the part, especially of the handle, which is gripped with the hand, can be made softer than for example a part to which existing components (for example loops or pole tubes) on the part can be attached.

It is also possible in the process as claimed in the invention to prepare and improve the attachment of other parts to the part by incorporating holding parts of metal or plastic.

The process as claimed in the invention can be advantageously used in the same manner when parts are produced in one piece or are to be produced from two half shells.

For example, in the process as claimed in the invention, in the production of a part in the form of a handle, the procedure is as follows:

A sheet material which is formed for example into a tubular shape and which is intended to form the outside surface of the handle (textile material, leather, hide, or the like) is inserted into a mold with a mold cavity which corresponds to the outside contour of the handle which is to be produced, for example the handle of a ski pole. Then the mold is closed and plastic is injected within the sheet material, for example into the interior of the tubing of sheet material. When the plastic is a nonfoaming plastic (for example, a thermoplastic or a curing plastic), the choice of the injection pressure ensures that the sheet material is pressed tightly against the inside surface of the mold cavity. After hardening of the core material, the mold is opened and the finished handle can be removed.

In one alternative procedure, to produce half shells of the handle the process can be such that a layer of sheet material is inserted into the closed mold with a mold cavity which corresponds to half of the handle to be produced. After closing the mold, as described above, the material of the core of the handle is injected. After hardening, the mold is opened and the half shell which has been produced in this way is joined to a second half shell (screwed, cemented, or welded or the like) in order to complete the handle.

Other details and features of the part as claimed in the invention, especially of the handle, and of the production process will become apparent from the following description of preferred embodiments.

DETAILED DESCRIPTION OF THE PREFERRED EMBODIMENTS

Even if the invention is described below using the example of a handle with a loop for a ski pole, the invention is not limited to handles for ski poles. Rather the part as claimed in the invention, which is for example a handle, can be made for all the uses which were named in the introductory part of the specification.

Figure 1:
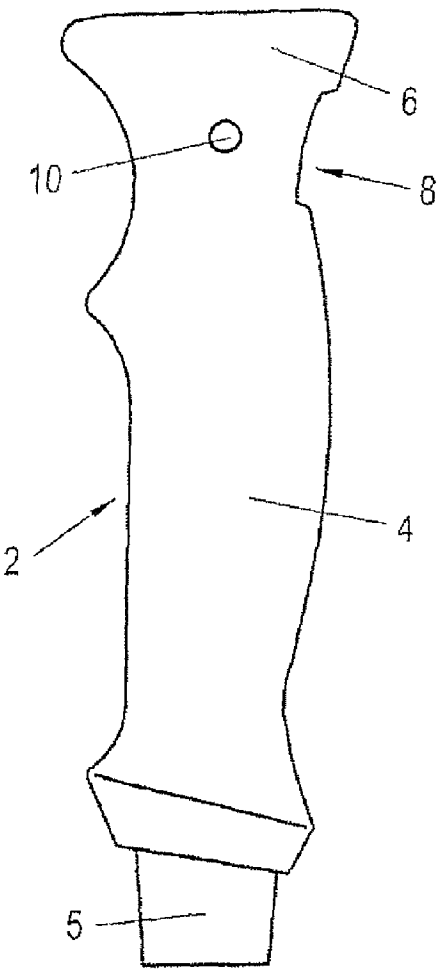
FIG. 1 shows a handle as claimed in the invention (without a loop) in a side view.

In the embodiment of a handle as claimed in the invention for ski poles shown schematically in FIG. 1, the handle 2 consists of a middle part 4 which is ergonomically shaped for gripping by the hand of the user. The handle 2 furthermore has a lower end 5 and a head 6.

In the illustrated embodiment the handle 2 is made in one piece and consists of a core 14 and a covering (lining) 12 of sheet material.

In the head 6 of the handle 2 there is a recess 8 which is open to one side (back) of the handle and in which there is a means for fixing a loop 18, as is conventional for the handles of athletic poles, especially poles for winter sports. This means can be a metal or plastic insert (holding part) which is embedded in the material of the core 14. This is especially the case when the material of the core 14 is soft. When the material of the core 14 has the necessary strength at least in the region in which the loop 18 is to be attached, the means for fixing the loop 18 can also be formed directly by the material of the core 14.

Even if in the illustrated embodiment the recess 8 is lined by the covering (lining 12), this is not an essential feature for the handle 2 as claimed in the invention. This is especially the case when there is a separate insert for fixing a loop 18 in the recess 8.

To fix the loop 18, in the illustrated embodiment a pin 10 is used which penetrates the head 6 of the handle 2.

Figure 2:
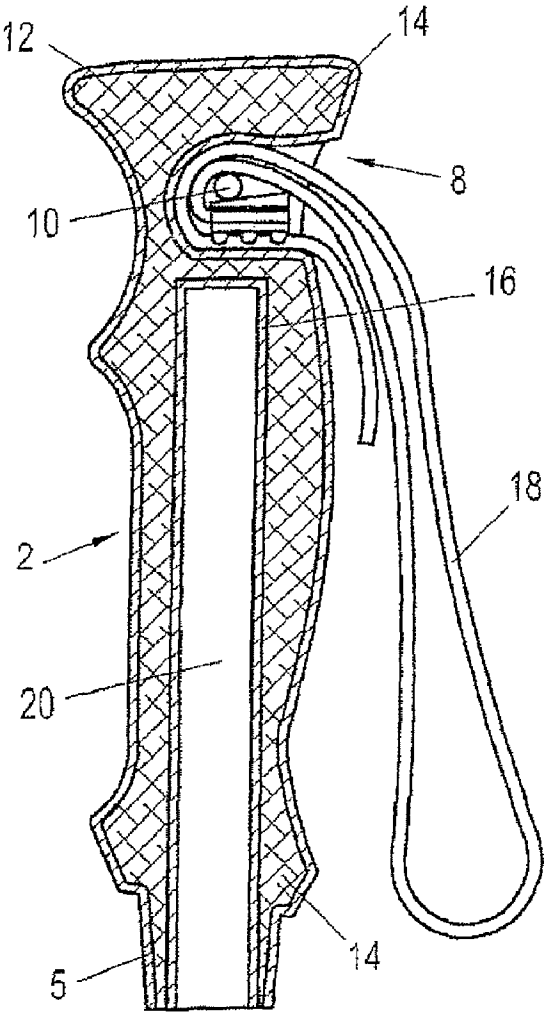
FIG. 2 shows a section through a first embodiment of the handle as claimed in the invention with a loop.

In the embodiment which is shown in FIG. 2, the outer surface of the handle 2 is formed by a covering 12. The covering 12 can be for example a textile material, leather, artificial leather or any other sheet material, for example one of the sheet materials named in the introductory part of the specification. Within the framework of the invention, natural materials, such as genuine leather, or textile materials of natural fibers, with favorable haptic properties, are preferred.

The core 14 of the handle 2 consists of soft foam (soft plastic foam) in the embodiment shown in FIG. 2 and contains embedded in itself a sleeve 16 which is made especially of plastic. The sleeve 16 with its interior defines a blind hole 20 which is open towards the lower end 5 of the handle 2.

FIG. 2 also shows how the loop 18 is fixed in the recess 8 in the head 6 of the handle 2 using a pin 10. In this connection, in the illustrated embodiment a loop 18 is shown which can be adjusted in its length by a clamping device.

If there is a sleeve 16 in the handle 2, on its upper end it can bear a means for fixing other parts on the handle 2, especially for fixing a loop 18 on the handle 2, as is known in principle from AT 006 848 U1. This means for fixing other components on the handle 2, especially loops 18, can however also be provided independently of the sleeve 16 in the upper part of the handle 2, especially in the upper part of its core 14.

These means are used especially when the core 14 of the handle 2 is formed from less stable material, especially soft foam.

It must be watched that the covering 12 of the handle 2 as claimed in the invention, as is shown in FIG. 2, can also line the inside surface of the recess 8 so that the core 14 is entirely surrounded by the covering 12.

Figure 3:
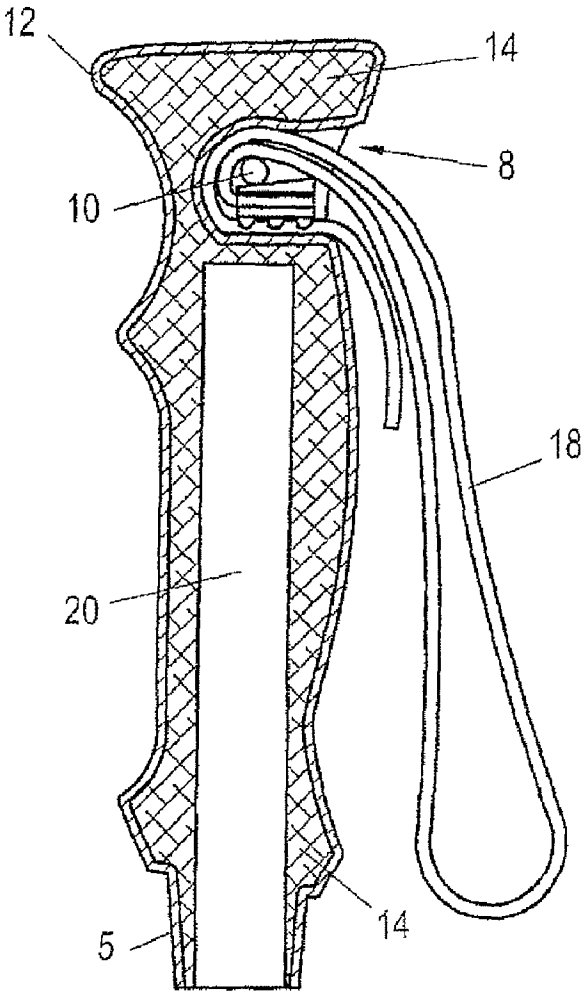
FIG. 3 shows in a section a second embodiment of a handle as claimed in the invention with a loop.

The embodiment of a handle 2 as claimed in the invention which is shown in FIG. 3 differs from the embodiment shown in FIG. 2 in that the core 14 consists of hard foam (hard plastic foam) and that within the core 14 the sleeve 16 is not inserted, but for holding the upper end of a pole tube a blind hole 20 is recessed and is open toward the lower end 5 of the handle 2.

In both cases, to attach the loop 18 in the plastic core 14—in the embodiment from FIG. 2 optionally connected to the sleeve 16 or made integrally with it—there is a holding device (not shown) for fixing the loop 18, as is known from AT 006 848 U1. This holding device relieves the material of the core 14 of the handle 2 as claimed in the invention and the material need not be made so strong that it can accommodate and withstand the forces applied to the handle 2 by the loop 18 when the handle is being used.

If in the part which can be gripped manually as claimed in the invention, especially a handle, there are to be molded parts which in the core 14 of the handle 2 for example define the blind hole 20 for holding a pole tube and/or the recess 8 for attaching a loop, the sample embodiment with an insert part 30, described below using FIGS. 4 and 5 on the example of a handle for athletic poles, especially ski poles or the like, has proven effective.

The insert part 30 which can be used in the part as claimed in the invention, especially a handle 2, consists of a tubular section 32 and a section 34 which is open to the side, the tubular section 32 defining the blind hole 20 for holding a pole tube, and the section 34 which is open to the side is designed to form the recess 8 for attaching a loop 18.

In this case it is provided that inserts 36, 38 can be pushed into the lower end of the tubular section 32 on the one hand and into the upper end of the section 34 which is open to the side. The insert 36 for the section 32 is made as a sleeve. The insert 38 for the section 34 of the insert part 30 is made essentially pot-shaped, i.e. is closed on one end.

Figure 5:
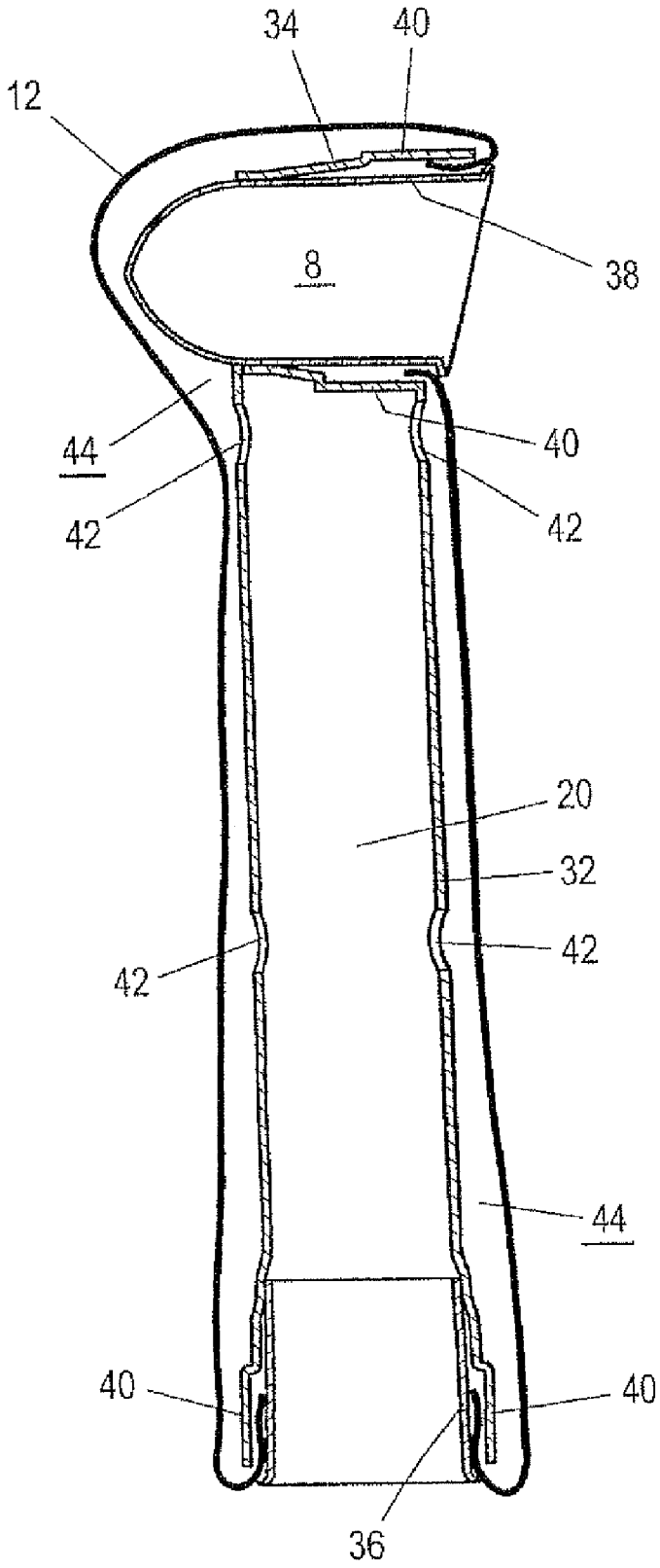
FIG. 5 shows the insert part in an axial section combined with a covering attached to it, before adding the material which forms the core.

Here it is provided that the covering 12 of sheet material, as is shown in FIG. 5, is clamped fast using the inserts 36, 38 on the tubular section 32 and on the laterally open section 34 of the insert part 30, forming a seal, so that when the mass which forms the core 14 of the handle 2 is placed in the space 44 between the insert part 30 and the jacket 12 (either in an injection molding process or by foaming) there is reliable sealing in the region of the openings (open ends of the blind hole 20 and the recess 8) in the handle 2.

In one embodiment the coveting 12 is tubular and for example has a shape which is at least approximate to the outside contour of the handle 2. The covering 12 can be formed especially from at least two patterns which are joined to one another with formation of a seam, for example cemented or bonded by heat. In the position of use, the seam or seams which join the patterns of the covering 12 to one another point to the inside; this means that the covering 12 after it has been joined to at least one, but preferably two patterns, is turned inside out. To hold the ends of the seam (seams) which are located within the covering 12 in the position of use of the covering 12, on the lower end region of the tubular section 32, therefore in the region of its opening into which the insert 36 is pushed when the covering 12 is clamped, there are bulges in which the ends of the seam come to rest. Analogous bulges 40 are provided on the section 34 of the insert part 30 which is open to the side.

It should be pointed out that the laterally open section 34 is made essentially tubular, and the unilateral termination of the recess 8 in which the loop 18 is to be attached is formed by the insert 38.

Figure 4:
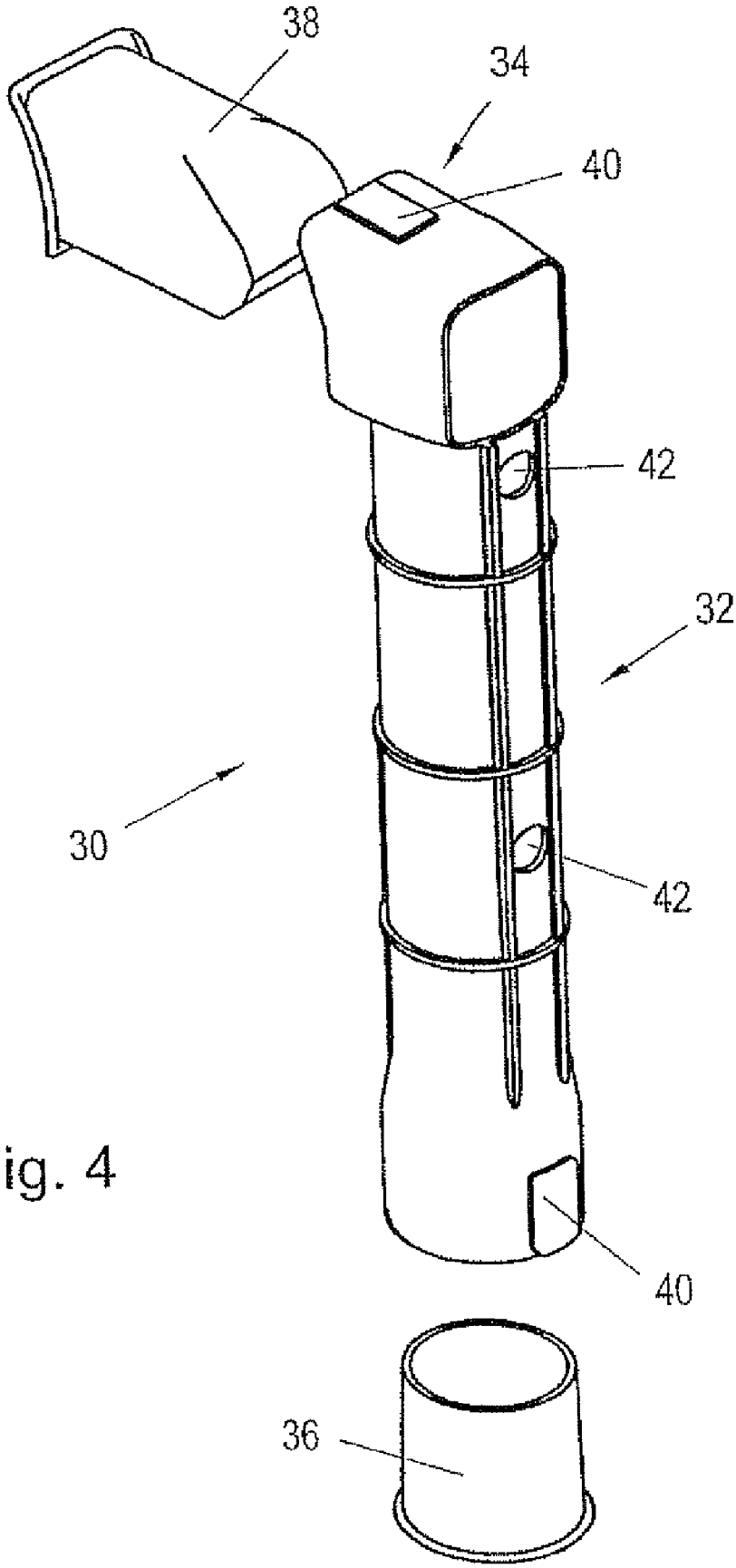
FIG. 4 shows in an exploded diagram an insert part for a handle made as claimed in the invention.

Within the framework of the invention, it is preferred that when using the handle 2 as claimed in the invention with the insert part 30 described using FIGS. 4 and 5 the tubular section 32 which defines the blind hole 20 is dimensioned such that it can be pressed onto the end of a pole tube especially without additional fasteners.

There are holes 42 for example in the tubular section 32 for the entry of the material which forms the core 14 of the handle 2 into the space 44 between the insert part 30 and the covering 12.

When producing the handle 2 as claimed in the invention, the procedure can be such that the covering 12, optionally in a shape similar to the outside shape of the finished handle 2, is inserted into the cavity of a mold with a cavity which corresponds to the outside shape of the handle 2, and that then the material (plastic) which forms the core 14 is placed, and if it is foamed plastic (for example, polyurethane foam), is foamed on. The foam pressure and/or the injection pressure presses the material which forms the covering 12 against the inside surface of the mold cavity so that the handle 2 easily contains the desired shape.

If in the handle 2 as claimed in the invention foamed plastic is not used for the core 14—foamed plastic is preferred for reasons of saving weight—the covering 12 can also be pressed against the inside surface of the mold cavity by the injection pressure of the material which forms the core 14.

In summary, one embodiment of the handle as claimed in the invention can be described as follows.

A part which can be gripped manually, especially a handle 2, especially for athletic poles or sticks, has a core 14 of soft or hard foam and a jacket 12 of leather or textile material or an imitation of these sheet materials. In the core 14 there is a blind hole 20 which is open toward the lower end 5 of the handle 2 and which, when the core 14 consists of soft foam, is formed by a sleeve 16 which is closed on the upper end and which is embedded in the core 14.

The invention claimed is:

1. A grippable part comprising:

a core (14) having a head end (6) and an opposite bottom end (5);

a covering (12) of sheet material which substantially encompasses the core (14);

an insert part (30), comprising a tubular section (32);

a first insert (38) configured to be pushed into a first end of the tubular section (32), the first end corresponding to the head end (6) of the core (14); and a second insert (36) configured to be pushed into an opposite second end of the tubular section (32), wherein said first and second inserts (36, 38) are configured to fix edges of the covering (12) onto the insert part (30), by clamping, upon being respectively pushed into the first and second ends.

2. The grippable part as claimed in claim 1, wherein core (14) has an inner blind hole (20) having an opening at the bottom end of the core.

3. The grippable part as claimed in claim 2, wherein the blind hole (20) is formed by the core (14).

4. The grippable part as claimed in claim 2, wherein the blind hole (20) is formed by a hollow sleeve (16) embedded in the core (13).

5. The grippable part as claimed in claim 4, wherein a first end of the sleeve (16), in correspondence with the head end (6) of the core (14), is closed.

6. The grippable part as claimed in claim 2, wherein the insert part (30) borders the blind hole (20).

7. The grippable part as claimed in claim 1, wherein the head end (6) of the core (14) has a recess (8) configured to receive a loop (18).

8. The grippable part as claimed in claim 7, wherein the covering (12) also lines a wall of the recess (8) at the head end (6) of the part (2).

9. The grippable part as claimed in claim 7, wherein the insert part (30) borders the recess (8).

10. The grippable part as claimed in claim 1, further comprising:

a pin (10) penetrating through the head end (6) of the core (14) for fixing a loop (18).

11. The grippable part as claimed in claim 1, wherein the core (14) consists of hard or soft foam.

12. The grippable part as claimed in claim 1, wherein the covering (12) completely encompasses the core (14).

13. The grippable part as claimed in claim 1, wherein the covering (12) is a material selected from the group consisting of leather, leather-like material, and hide.

14. The grippable part as claimed in claim 1, wherein the covering (12) consists of textile material.

15. The grippable part as claimed in claim 1, wherein the core has regions of hard plastic and regions of soft plastic.

16. The grippable part as claimed in claim 1, wherein in the core (14) includes an attaching means for attaching other components.

17. The grippable part as claimed in claim 16, wherein the attaching means is a sleeve (16) for holding a pole tube.

18. The grippable part as claimed in claim 16, wherein the attaching means is an insert for fixing a pole loop (18).

19. The grippable part as claimed in claim 1, wherein an inside of the material which forms the covering (12) is coated with a layer configured to close pores within the material.

20. The grippable part as claimed in claim 19, wherein the layer is a film joined to the material.

21. The grippable part as claimed in claim 1, wherein the covering (12) consists of a textile material which bears a film on an inside of the textile material.

22. The grippable part as claimed in claim 1, wherein the grippable part, comprises two half shells joined to one another.

23. The grippable part as claimed in claim 22, wherein at least an outside of the half shells is coated with the covering (12) of sheet material.

24. The grippable part as claimed in claim 1, wherein the first insert (38) is located at the head end (6) of the core (14) and forms an inside surface of a recess (8) extending into the head end (6) of the core (14).

25. The grippable part as claimed in claim 1, wherein the tubular section (32) of the insert part (30) extends along a longitudinal direction and has an opening at the second end, and wherein the insert part (30) further comprises a section (34) at the first end having an opening facing a direction substantially perpendicular to the longitudinal direction of the insert part (30), the section (34) configured to receive the first insert (38).

26. The grippable part as claimed in claim 1, wherein the grippable part is a handle.

27. The grippable part as claimed in claim 26, wherein the part is a handle for an athletic pole.

28. The grippable part as claimed in claim 27, wherein the part is a handle for an athletic pole for ski sports and/or hiking.

* * * * *